US011648767B2

(12) United States Patent
Kubo

(10) Patent No.: US 11,648,767 B2
(45) Date of Patent: May 16, 2023

(54) PRINTING SYSTEM

(71) Applicant: Brother Kogyo Kabushiki Kaisha, Aichi-Ken (JP)

(72) Inventor: Isao Kubo, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/216,999

(22) Filed: Mar. 30, 2021

(65) Prior Publication Data

US 2021/0300023 A1 Sep. 30, 2021

(30) Foreign Application Priority Data

Mar. 31, 2020 (JP) ..... JP2020-064877

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586
See application file for complete search history.

(56) References Cited

U.S. PATENT DOCUMENTS

| | | | | |
|---|---|---|---|---|
| 7,747,905 | B2 | 6/2010 | Odani | |
| 9,056,512 | B1 * | 6/2015 | Kanzaki | B41J 2/17596 |
| 11,273,636 | B2 * | 3/2022 | Johnson | B41J 2/04536 |
| 2008/0126870 | A1 | 5/2008 | Odani | |
| 2013/0265352 | A1 * | 10/2013 | Burress | B41J 2/04581 347/68 |

FOREIGN PATENT DOCUMENTS

| | | | |
|---|---|---|---|
| JP | 2003-300313 | A | 10/2003 |
| JP | 2008-015568 | A | 1/2008 |
| JP | 2015-178178 | A | 10/2015 |
| JP | 2015-178179 | A | 10/2015 |

* cited by examiner

*Primary Examiner* — Thinh H Nguyen
(74) *Attorney, Agent, or Firm* — Banner & Witcoff, Ltd.

(57) ABSTRACT

A printing system includes a controller. The controller is configured to: receive first condition information related to an ejection failure in a printer; determine a maintenance manner applicable to the first condition information; cause the printer to perform a maintenance in the determined maintenance manner; receive second condition information related to the ejection failure in the printer after the maintenance is performed; determine whether an ejection performance in the printer has been improved based on the second condition information in response to performing the maintenance; update an evaluation index in accordance with determination of whether the ejection performance in the printer has been improved, the evaluation index corresponding to the determined maintenance manner.

19 Claims, 6 Drawing Sheets

FIG. 3A

DB

| NO. | FAILURE NOZZLE PERCENTAGE/ PATTERN | OCCURRENCE AREA | PRINTER CONDITION | MAINTENANCE MANNER | RANK | RANK UPDATE DATE |
|---|---|---|---|---|---|---|
| 1 | FAILURE NOZZLE PERCENTAGE 50% OR MORE | N/A | AVG. TEMP. SINCE LAST EJECTION FAILURE DETECTION Y1°C OR HIGHER | SUCTION PURGE / HIGH | 9 | FEB. 5, 2020 |
| 2 | | | | SUCTION PURGE / HIGH & EXHAUST PURGE | 8 | FEB. 10, 2020 |
| 3 | | | AVG. TEMP. SINCE LAST EJECTION FAILURE DETECTION LOWER THAN Y1°C | SUCTION PURGE / HIGH | 6 | FEB. 1, 2020 |
| 4 | | | | SUCTION PURGE / MEDIUM | 7 | FEB. 13, 2020 |
| 5 | FAILURE NOZZLE PERCENTAGE 12.5% OR MORE BUT LESS THAN 50% | MOST IN UPSTREAM PORTION OF HEAD | N/A | SUCTION PURGE / LOW | 4 | FEB. 2, 2020 |
| 6 | | | | SUCTION PURGE / MEDIUM | 6 | FEB. 3, 2020 |
| 7 | | MOST IN DOWNSTREAM PORTION OF HEAD | N/A | SUCTION PURGE / MEDIUM | 6 | FEB. 3, 2020 |
| 8 | | | | SUCTION PURGE / HIGH | 8 | FEB. 8, 2020 |
| 9 | | RANDOM | N/A | SUCTION PURGE / LOW | 7 | JAN. 30, 2020 |
| 10 | | | | SUCTION PURGE / MEDIUM | 9 | FEB. 11, 2020 |

FIG. 3B

DB

| NO. | FAILURE NOZZLE PERCENTAGE/ PATTERN | OCCURRENCE AREA | PRINTER CONDITION | MAINTENANCE MANNER | RANK | RANK UPDATE DATE |
|---|---|---|---|---|---|---|
| 11 | FAILURE NOZZLE PERCENTAGE LESS THAN 12.5% | ALL IN UPSTREAM PORTION OR DOWNSTREAM PORTION OF HEAD | AVG. TEMP. SINCE LAST EJECTION FAILURE DETECTION Y2°C OR HIGHER | SUCTION PURGE / LOW | 6 | FEB. 2, 2020 |
| 12 | | | | SUCTION PURGE / MEDIUM | 7 | FEB. 5, 2020 |
| 13 | | | AVG. TEMP. SINCE LAST EJECTION FAILURE DETECTION LOWER THAN Y2°C | HIGH VOLTAGE FLUSHING (TARGET NOZZLE ONLY) | 8 | JAN. 23, 2020 |
| 14 | | | | SUCTION PURGE / LOW | 7 | FEB. 8, 2020 |
| 15 | | RANDOM | AVG. TEMP. SINCE LAST EJECTION FAILURE DETECTION Y2°C OR HIGHER | SUCTION PURGE / LOW | 5 | FEB. 10, 2020 |
| 16 | | | | SUCTION PURGE / MEDIUM | 5 | FEB. 11, 2020 |
| 17 | | | AVG. TEMP. SINCE LAST EJECTION FAILURE DETECTION LOWER THAN Y2°C | HIGH VOLTAGE FLUSHING (TARGET NOZZLE ONLY) | 8 | FEB. 1, 2020 |
| 18 | | | | SUCTION PURGE / LOW | 6 | FEB. 14, 2020 |
| 19 | FAILURE NOZZLES LOCATED NEXT TO EACH OTHER IN MAIN SCANNING DIRECTION | N/A | SHEET CONVEYANCE FAILURE OCCURRED IMMEDIATELY BEFORE EJECTION FAILURE DETECTION | SUCTION PURGE / LOW | 3 | FEB. 1, 2020 |
| 20 | | | | SUCTION PURGE / MEDIUM | 4 | FEB. 13, 2020 |
| 21 | | N/A | NO SHEET CONVEYANCE FAILURE OCCURRED IMMEDIATELY BEFORE EJECTION FAILURE DETECTION | SUCTION PURGE / LOW | 7 | JAN. 30, 2020 |
| 22 | | | | SUCTION PURGE / MEDIUM | 5 | FEB. 6, 2020 |

PRINTING SYSTEM

CROSS-REFERENCE TO RELATED APPLICATION

This application claims priority from Japanese Patent Application No. 2020-064877 filed on Mar. 31, 2020, the content of which is incorporated herein by reference in its entirety.

TECHNICAL FIELD

Aspects of the disclosure relate to a printing system including a server and a printer that performs maintenance of an ejection head.

BACKGROUND

A known maintenance system includes an estimation model used for estimating a recommended timing of a nozzle performance check based on use conditions. In such a maintenance system, the estimation model is updated based on a history of the actual use conditions after an ejection head is cleaned. This update improves appropriateness of the estimation model. The improvement of the appropriateness narrows a gap between the recommended timing of the nozzle performance check determined based on the estimation model and a timing at which an ejection failure actually occurs, thereby improving determination accuracy of the recommended timing.

SUMMARY

In the known maintenance system, the determination accuracy of the recommended timing at which maintenance is to be performed next and subsequent times may be improved by updating the estimation model based on the history of the actual use conditions after maintenance is performed. In other words, the timing at which maintenance was actually performed may be evaluated and the estimation model may be updated based on the evaluation result. The update of the estimation model may improve reliability of the recommended timing at which maintenance is to be performed. Nevertheless, in the known maintenance system, a manner of the performed maintenance might not be evaluated, and consideration might not be given to re-evaluation of the same maintenance according to situations in which an ejection failure has occurred after the maintenance.

Accordingly, aspects of the disclosure provide a printing system that may recommend a suitable maintenance manner for resolving an ejection failure by evaluating the maintenance manner using an evaluation index and re-evaluating the maintenance manner according to the degree of improving ejection performance after maintenance is performed in the maintenance manner.

In one or more aspects of the disclosure, a printing system includes a controller. The controller is configured to: receive first condition information related to an ejection failure in a printer; determine a maintenance manner applicable to the first condition information; cause the printer to perform a maintenance in the determined maintenance manner; receive second condition information related to the ejection failure in the printer after the maintenance is performed; determine whether an ejection performance in the printer has been improved based on the second condition information in response to performing the maintenance; update an evaluation index in accordance with determination of whether the ejection performance in the printer has been improved, the evaluation index corresponding to the determined maintenance manner.

According to one or more aspects of the disclosure, the printing system may recommend a suitable maintenance manner for resolving an ejection failure by evaluating the maintenance manner using an evaluation index and re-evaluating the maintenance manner according to the degree of improving ejection performance after maintenance is performed in the maintenance manner.

BRIEF DESCRIPTION OF THE DRAWINGS

FIG. 3A is a table showing an example database stored in a memory of a server according to one or more illustrative embodiments of the disclosure.

FIG. 3B is a continuation of the table of FIG. 3A according to one or more illustrative embodiments of the disclosure.

DETAILED DESCRIPTION

Hereinafter, an illustrative embodiment will be described with reference to the accompanying drawings. In the illustrative embodiment, a description will be provided on a printing system including one or more printers. The printing system may enable a service provider to offer a printing service using the one or more printer to a customer (i.e., a user) who pays a fee for the service.

General Configuration of Printer

Figure 1:
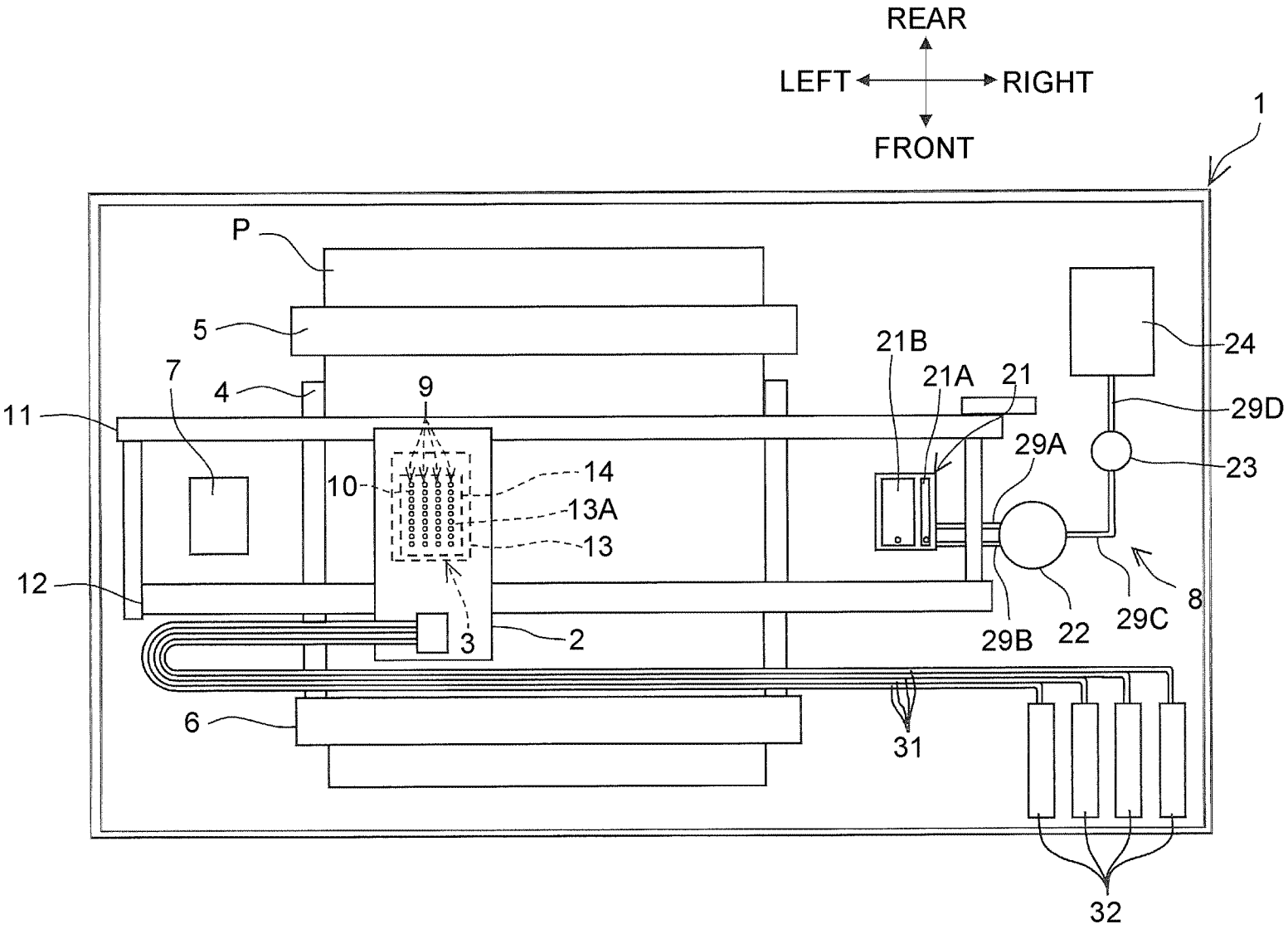
FIG. 1 illustrates a general configuration of one of printers included in a printing system according to one or more illustrative embodiments of the disclosure.

Referring to FIG. 1, a description will be provided on one of printers 1 that is included in a printing system 100 (refer to FIG. 2) and owned by a service provider that offers a printing service using the printer 1 to a customer. The printers 1 may be owned by different service providers that offer the printing service using the respective printers 1. All of the printers 1 have an identical configuration, and therefore, the description will be provided on one of the printers 1. As illustrated in FIG. 1, the printer 1 includes a carriage 2, an inkjet head 3, a platen 4, conveyance rollers 5 and 6, a foam 7, and a purging unit 8. A side of the printer 1, in which the purging unit 8 may be located, may be defined as the right of the printer 1. A side of the printer 1, in which the foam 7 may be located, may be defined as the left of the printer 1. A side of the printer 1, in which the conveyance roller 6 may be located, may be defined as the front of the printer 1. A side of the printer 1, in which the conveyance roller 5 may be located, may be defined as the rear of the printer 1. A right-left direction corresponds to a main scanning direction. A frontward direction corresponds to a conveyance direction in which a recording sheet P is conveyed.

The printer 1 may be an example of a printing apparatus. The carriage 2 may be an example of a moving unit and also an example of a printing unit. The inkjet head 3 may be an example of an ejection head.

The carriage 2 is connected to a carriage motor 56 (refer to FIG. 2) via a belt. The carriage 2 is configured to move in the main scanning direction along guide rails 11 and 12, in response to the carriage motor 56 being driven.

The inkjet head 3 is connected to a plurality of tubes, for example, four tubes 31. The tubes 31 are connected to four ink cartridges 32, respectively. The ink cartridges 32 are disposed next to each other in the main scanning direction at a right front corner portion of the printer 1. The inkjet head 3 is supplied with black ink, yellow ink, cyan ink, and magenta ink stored in the respective ink cartridges 32 via the respective tubes 31.

The inkjet head 3 is mounted on the carriage 2. While the carriage 2 moves the inkjet head 3 in the main scanning direction, the inkjet head 3 ejects ink to perform printing. The inkjet head 3 includes a channel unit 13 and an actuator 14.

The channel unit 13 has a nozzle surface 13A that may be its lower surface. The nozzle surface 13A has nozzles 10. The channel unit 13 includes ink channels including the nozzles 10. The nozzles 10 are arranged in four rows in the conveyance direction orthogonal to the main scanning direction to form nozzle rows 9. The nozzle rows 9 are disposed next to each other in the main scanning direction at the nozzle surface 13A. In each nozzle row 9, the nozzles 10 are substantially equally spaced in the conveyance direction. The nozzles 10 in adjacent nozzle rows 9 are aligned in the main scanning direction.

The nozzle rows 9 include a black nozzle row, a yellow nozzle row, a cyan nozzle row, and a magenta nozzle row in this order from the right. The inkjet head 3 is configured to eject black ink, yellow ink, cyan ink, and magenta ink from the nozzles 10 belonging to the respective corresponding nozzle rows 9. The nozzles 10 included in a single nozzle row 9 are provided for a single color of ink. A corresponding color of ink is supplied to the nozzles 10 included in a single nozzle row 9 via a common tube 31 and a common ink channel. That is, ink stored in an ink cartridge 32 flows to each nozzle 10 included in a single nozzle row 9 through a corresponding common tube 31 and a corresponding common ink channel in this order. Thus, each nozzle row 9 includes an upstream nozzle 10 and a downstream nozzle 10 located relative to each other in a direction in which ink flows in a corresponding ink channel.

The actuator 14 is configured to apply ejection energy to ink stored in each nozzle 10 individually, in response to the actuator 14 being driven.

The platen 4 is disposed below the inkjet head 3. The platen 4 faces the nozzle surface 13A during printing. The platen 4 has a size that extends over the entire width of a recording sheet P in the main scanning direction. The platen 4 may support a recording sheet P from below. The recording sheet P may be an example of a recording medium. The conveyance roller 5 is located upstream from the platen 4 in the conveyance direction. The conveyance roller 6 is located downstream from the platen 4 in the conveyance direction. The conveyance rollers 5 and 6 are connected to a conveyance motor 57 (refer to FIG. 2) via gears. The conveyance rollers 5 and 6 are configured to rotate to convey a recording sheet P in the conveyance direction, in response to the conveyance motor 57 being driven.

Such a configuration may enable the printer 1 to perform printing on a recording sheet P. More specifically, every time the conveyance rollers 5 and 6 convey a recording sheet P by a certain distance, the inkjet head 3 ejects ink from one or more nozzles 10 while the carriage 2 moves in the main scanning direction.

Foam

The foam 7 includes ink absorbable material such as sponge, and is disposed further to the left than the platen 4. In the printer 1, thus, the carriage 2 is movable to position at a flushing position where the nozzle surface 13A faces the form 7 under control of a controller 50 of the printer 1. Such a configuration may thus enable the printer 1 to perform flushing.

Purging Unit

The purging unit 8 includes a cap 21, a switching unit 22, a suction pump 23, and a waste liquid tank 24.

The cap 21 is disposed further to the right than the platen 4. In the printer 1, thus, the carriage 2 is movable to position at a maintenance position where the nozzle surface 13A faces the cap 21 under control of the controller 50. The cap 21 includes a capping portion 21A and a capping portion 21B disposed to the left of the capping portion 21A. In a state where the carriage 2 is positioned at the maintenance position, the nozzles 10 belonging to the rightmost nozzle row 9 face the capping portion 21A and the nozzles 10 belonging to the other three nozzle rows 9 face the capping portion 21B.

Figure 2:
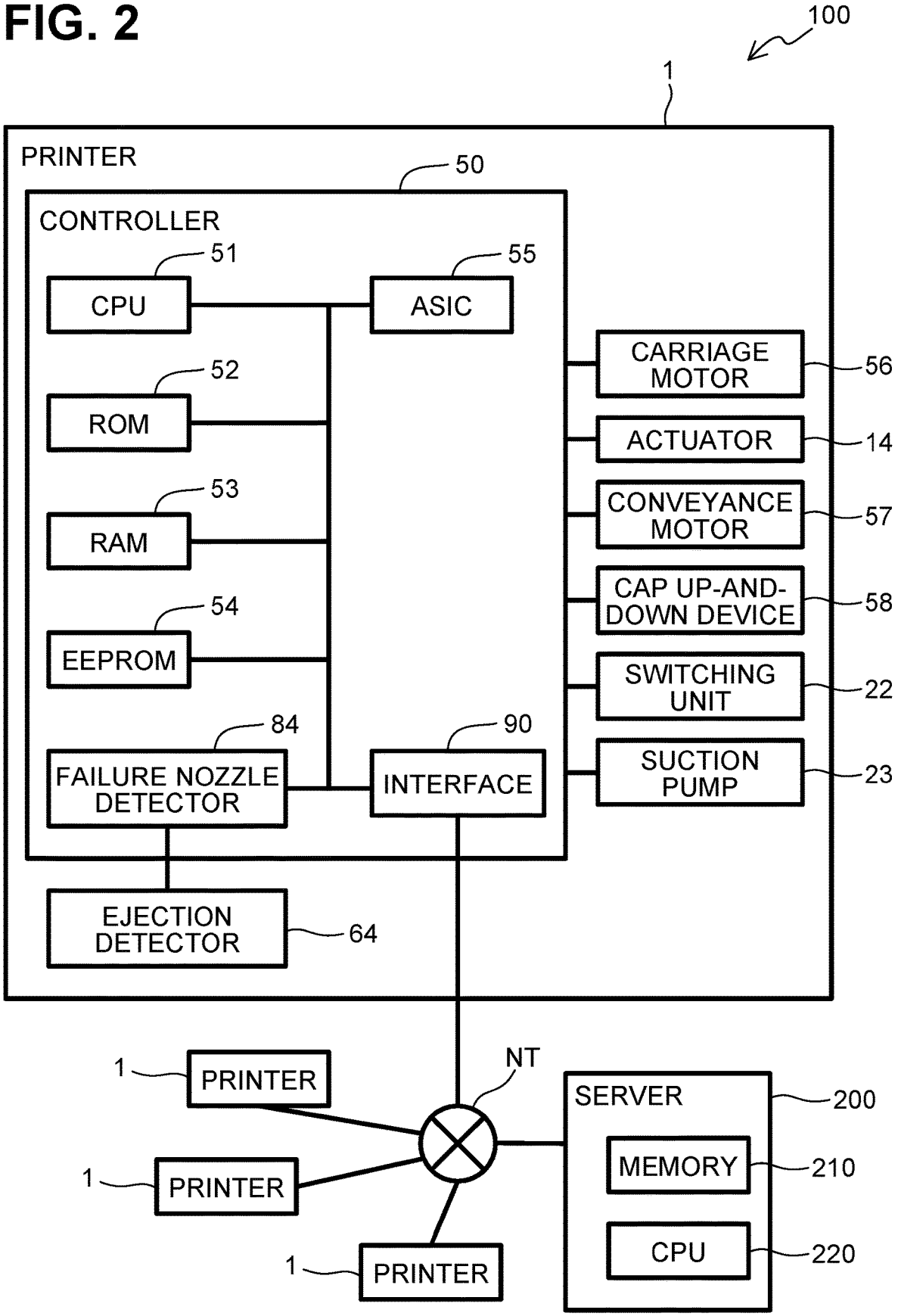
FIG. 2 is a block diagram illustrating a configuration of the printing system including the printer of FIG. 1 and other printers and an electrical configuration of one of the printers according to one or more illustrative embodiments of the disclosure.

The cap 21 is movable upward and downward selectively under control of a cap up-and-down device 58 (refer to FIG. 2). That is, the cap 21 is movable in a direction intersecting the nozzle surface 13A between a capping position and an uncapping position. When the cap 21 is moved upward in a state where the carriage 2 is positioned at the maintenance position, the cap 21 comes into intimate contact with the nozzle surface 13A of the inkjet head 3 to cover the nozzles 10. More specifically, the capping portion 21A covers the nozzles 10 belonging to the rightmost nozzle row 9 and the capping portion 21B covers the nozzles 10 belonging to the other three nozzle rows 9. Hereinafter, the state where the cap 21 covers the nozzles may be referred to as a "capping state". The state where the cap 21 is not in the capping state may be referred to as an "uncapping state". As described above, the cap up-and-down device 58 is configured to move the cap 21 upward and downward between the capping position and the uncapping position. When the cap 21 is located at the capping position, the cap 21 is in the capping state. The uncapping position is lower than the capping position.

The cap 21 may have an alternative configuration to intimately contact the nozzle surface 13A to cover the nozzles 10. Such alternative configuration may include the channel unit 13 including a frame that surrounds the nozzle surface 13A for protecting the nozzles 10. In this case, the cap 21 may intimately contact the frame to cover the nozzles 10.

The switching unit 22 is connected to the capping portions 21A and 21B via tubes 29A and 29B, respectively. The switching unit 22 is also connected to the suction pump 23 via a tube 29C. The switching unit 22 switches a connection destination of the suction pump 23 between the capping portion 21A and the capping portion 21B. The suction pump 23 may be a peristaltic pump. The suction pump 23 has one end connected to the waste liquid tank 24 via a tube 29D and the other end connected to the switching unit 22 via the tube 29C.

The purging unit 8 and the foam 7 may be examples of a maintenance unit.

Printing System

Referring to FIG. 2, a description will be provided on a configuration of the printing system 100 including the printers 1. The printing system 100 includes a plurality of the printers 1 and a server 200. Each printer 1 and the server 200 are connected to a network NT. Each printer 1 is thus communicable with the server 200 via the network NT.

Server

The server 200 includes a memory 210 and a CPU 220. The memory 210 stores a database DB (refer to FIGS. 3A and 3B). The CPU 220 may be an example of a second controller. The memory 210 may be an example of a storage.

Printer

Referring to FIG. 2, a description will be provided on an electrical configuration of the printer 1. The printer 1 further includes the controller 50. The controller 50 controls operation of the printer 1.

The controller 50 includes a CPU 51, a ROM 52, a RAM 53, an EEPROM 54, an ASIC 55, and an interface 90. The CPU 51 may be an example of a first controller. Such a configuration enables the controller 50 to control the carriage motor 56, the actuator 14, the conveyance motor 57, the cap up-and-down device 58, the switching unit 22, and the suction pump 23.

The controller 50 further includes a failure nozzle detector 84 configured to detect an ink ejection failure caused by clogging of a nozzle 10 in the inkjet head 3 or other causes. The failure nozzle detector 84 is connected to an ejection detector 64 disposed at a position where the ejection detector 64 faces the inkjet head 3. The ejection detector 64 includes a conductive material that may be electrically connected to an ink absorbing material. The failure nozzle detector 84 is configured to detect an electrical signal traveling through the conductive material. More specifically, the failure nozzle detector 84 is configured to detect a signal indicating changes in current caused in response to driving the inkjet head 3 to eject a charged ink droplet toward the absorbing material. In a case where a value of the signal is less than or equal to a certain threshold, the failure nozzle detector 84 determines that a certain amount of ink has not been ejected from the particular nozzle 10 or no ink has been ejected from the particular nozzle 10. In other words, the failure nozzle detector 84 is configured to detect a failure nozzle 10 that has failed to eject ink. The failure nozzle detector 84 may be an example of an ejection failure detector.

Nevertheless, the detection of a failure nozzle 10 may be implemented in another manner. For example, the controller 50 may control the carriage motor 56 and the conveyance rollers 5 and 6 to cause the inkjet head 3 to print an appropriate test pattern. Then, the test pattern may be scanned using a CCD or another photosensor to detect which nozzle 10 is a failure nozzle.

The interface 90 may be a wired or wireless LAN interface that enables the printer 1 to communicate with another device. The interface 90 is connected to the network NT.

Although, as illustrated in FIG. 2, the controller 50 includes a single CPU 51, the controller 50 may include a plurality of CPUs 51. In this case, processing tasks may be divided among the CPUs 51. Although, as illustrated in FIG. 2, the controller 50 includes a single ASIC 55, the controller 50 may include a plurality of ASICs 55. In this case, processing tasks may be divided among the ASICs 55.

Flushing

Next, a description will be provided on flushing to be performed as the maintenance described above.

The printer 1 performs flushing under control of the controller 50. The flushing is that, in a state where the carriage 2 is located at the flushing position, the controller 50 drives the actuator 14 to cause the inkjet head 3 to discharge from the nozzles 10 ink that may have high viscosity. The details of flushing are as described below.

When the printer 1 is in a standby mode, the cap 21 is in the capping state to reduce ink evaporation due to evaporation of moisture in ink at the nozzles 10. During printing, first, the controller 50 controls the cap up-and-down device 58 to move the cap 21 downward. Then, the controller 50 controls the carriage motor 56 to move the carriage 2 to stop at the flushing position, and controls the actuator 14 to perform flushing. A intensity mode of flushing may be controlled between a high intensity mode and a low intensity mode under control of the controller 50. More specifically, the controller 50 switches voltage to be applied to the actuator 14 between a high voltage and a low voltage to change the intensity mode of flushing. The controller 50 may control the actuator 14 for each individual nozzle 10. After flushing, while the controller 50 controls the carriage motor 56 to move the carriage 2 in the main scanning direction within a range in which the nozzle surface 13A faces a recording sheet P, the controller 50 controls the actuator 14 to cause the inkjet head 3 to eject ink from appropriate one or more nozzles 10 to perform printing. After printing, the controller 50 controls the carriage motor 56 to move the carriage 2 to stop at the maintenance position. Then, the controller 50 controls the cap up-and-down device 58 to move the cap 21 upward to bring the cap 21 into the capping state.

Purge

Next, a description will be provided on a purge to be performed by the purging unit 8 as the maintenance described above.

In a state where the cap 21 is in the capping state, the controller 50 controls the switching unit 22 to connect the suction pump 23 to the capping portion 21A and then drives the suction pump 23. That is, the printer 1 performs a suction purge for discharging black ink in the channel unit 13 from the nozzles 10 belonging to the rightmost nozzle row 9.

Thereafter, in the printer 1, while the cap 21 is maintained in the capping state, the controller 50 controls the switching unit 22 to connect the suction pump 23 to the capping portion 21B and then drives the suction pump 23. That is, the printer 1 performs a suction purge for discharging color inks such as yellow ink, cyan ink, and magenta ink in the respective channel units 13 from the nozzles 10 belonging to the other three nozzle rows 9. Ink discharged from the inkjet head 3 by the respective suction purges is collected in the waste liquid tank 24.

In addition to the suction purges, the printer 1 may perform an exhaust purge for discharging air entered and trapped in an air trap chamber from the nozzles 10. The air trap chamber is disposed above the nozzles 10 in the inkjet head 3. The exhaust purge may be implemented by a known configuration and manner.

In the illustrative embodiment, as described above, the printer 1 performs a purge or flushing as maintenance. In both of the purge and flushing, ink is consumed due to discharging. Nevertheless, in other embodiments, the printer 1 may perform another operation as maintenance. For example, ink may be circulated such that ink may be supplied from a cartridge to an inkjet head and residual ink after printing may be supplied to the inkjet head again via a circulation channel. An ink circulation speed may be increased as maintenance. Such a circulation may reduce increase of the ink viscosity without wasting ink, thereby improving the ink ejection performance of the inkjet head 3.

Maintenance Evaluation

In the printing system 100, a respective printer 1 performs maintenance in a particular maintenance manner. The particular maintenance manner adopted in the maintenance is rated on a scale of points that may be an evaluation index. The evaluation index indicates effectiveness of the maintenance manner for recovering ejection performance of the nozzles 10. The evaluation history and the evaluation indexes are stored in the database DB stored in the memory 210 of the server 200.

Database

Referring to FIGS. 3A and 3B, a description will be provided on the database DB. The database DB is a merely example. The database DB includes twenty-two records with record numbers from 1 to 22. The database DB includes fields for "failure nozzle percentage/pattern", "occurrence area", "printer condition", "maintenance manner", "rank", and "rank update date". Each record includes a value or details of each field.

The field "failure nozzle percentage/pattern" indicates a percentage of failure nozzles 10 detected by the failure nozzle detector 84 with respect to the total number of nozzles 10 in the inkjet head 3, or a location pattern of detected failure nozzles 10. The percentage of failure nozzles 10 may be an example of first data. The percentage of failure nozzles 10 is hereinafter referred to as a "failure nozzle percentage". The location pattern of detected failure nozzles 10 may be an example of second data. The details of the field "failure nozzle percentage/pattern" may be hereinafter simply referred to as "failure nozzle data".

In this example, in each of the records of Nos. 1 to 4, the failure nozzle data indicates that the failure nozzle percentage is 50% or more. In each of the records of Nos. 5 to 10, the failure nozzle data indicates that the failure nozzle percentage is 12.5% or more but less than 50%. In each of the records of Nos. 11 to 18, the failure nozzle data indicates that the failure nozzle percentage is less than 12.5%. In each of the records of Nos. 19 to 22, the failure nozzle data indicates that the nozzles 10 includes two or more failure nozzles 10 that are located next to each other in the main scanning direction and included in two or more of the nozzle rows 9.

The field "occurrence area" indicates an area where the failure nozzles 10 are detected in the inkjet head 3 by the failure nozzle detector 84. Hereinafter, such an area may be simply referred to as an "occurrence area". The occurrence area is another example of the second data. The details of the field "occurrence area" may be hereinafter simply referred to as "occurrence area data".

In this example, in each of the records of Nos. 5 and 6, the occurrence area data indicates that most of the failure nozzles 10 are located in an upstream portion of the inkjet head 3 along the one or more ink channels. In each of the records of Nos. 7 and 8, the occurrence area data indicates that most of the failure nozzles 10 are located in a downstream portion of the inkjet head 3 along the one or more ink channels. In each of the records Nos. 9 and 10, the occurrence area data indicates that the failure nozzles 10 are randomly located in both the upstream portion and the downstream portion of the inkjet head 3. In each of the records of Nos. 11 to 14, the occurrence area data indicates that all of the failure nozzles 10 is located in the upstream portion or in the downstream portion of the inkjet head 3 along the one or more ink channels. In each of the records Nos. 15 to 18, the occurrence area data indicates that the failure nozzles 10 are randomly located in both of the upstream portion and the downstream portion of the inkjet head 3.

The database DB may include both or only one of the first data and the second data. That is, in this illustrative embodiment, the database DB only need to include at least one of the first data or the second data, and the at least one of the first data or the second data only need to be taken into consideration in selecting and determining a maintenance manner to be adopted.

The field "printer condition" indicates temperature detected by a temperature sensor and humidity detected by a humidity sensor. The sensors are disposed in the printer 1. The temperature sensor detects temperature at the printer 1. The temperature may be an example of a detector that detects a condition of the printer 1. The humidity sensor detects humidity at the printer 1. The humidity sensor may be another example of the detector. The field "printer condition" also indicates the presence or absence of a sheet conveyance failure. The printer 1 further includes a sensor that determines a sheet conveyance condition. An occurrence of a sheet conveyance failure is detected based on, for example, a detection result of the sensor and a drive control condition of the conveyance motor 57. The function of detecting a sheet conveyance failure using such a sensor may be another example of the detector.

The details of the field "printer condition" may be hereinafter simply referred to as "printer condition data".

In each of the records of Nos. 1 and 2, the printer condition data indicates that an average temperature between the previous ejection failure detection and the latest ejection failure detection by the failure nozzle detector 84 is Y1 [° C.] or higher. In each of the records of Nos. 3 and 4, the printer condition data indicates that the average temperature is lower than Y1 [° C.].

Hereinafter, the average temperature between the previous ejection failure detection and the latest ejection failure detection by the failure nozzle detector 84 may be simply referred to as an "average temperature since the last ejection failure detection". The value "Y1" is a threshold specified in advance, and may be a criterion for occurrence of inhibition of ink flow due to a growth of air mass intruded into the ink channels.

In each of the records of Nos. 11, 12, 15, and 16, the printer condition data indicates that the average temperature since the last ejection failure detection is Y2 [° C.] or higher. In each of the records of Nos. 13, 14, 17, and 18, the printer condition data indicates that the average temperature since last ejection failure detection is lower than Y2 [° C.]. The value "Y2" is a threshold specified in advance, and may be a criterion for occurrence of, for example, inhibition of ink flow due to increase of the ink viscosity under low temperature environment. The value "Y2" is less than the value "Y1".

In each of the records of Nos. 19 and 20, the printer condition data indicates that a sheet conveyance failure has occurred due to a contact between the inkjet head 3 and a recording sheet P immediately before an ejection failure detection by the failure nozzle detector 84 is performed. More specifically, for example, the occurrence of such a sheet conveyance failure may be detected when, for example, the carriage 2 moves in a state where a floating recording sheet P contacts the lower surface of the inkjet head 3. In each of the records of Nos. 21 and 22, the printer condition data indicates that such a conveyance failure has not occurred immediately before an ejection failure detection.

The field "maintenance manner" indicates a maintenance manner that has been adopted in previous maintenance, and a suction intensity mode. Nevertheless, the field "maintenance manner" might not necessarily include all the data but only need to include at least one of the maintenance manner or the suction intensity mode. Hereinafter, the details of the field "maintenance manner" may be simply referred to as "maintenance manner data".

In each of the records Nos. 1, 2, 3, and 8, the maintenance manner data indicates that a suction purge was performed by the purging unit 8 at a high intensity mode. In the record of No. 2, the maintenance manner data indicates that an exhaust purge was performed in addition to a suction purge. In each of the records of Nos. 4, 6, 7, 10, 12, 16, 20, and 22, the maintenance manner data indicates that a suction purge was performed by the purging unit 8 at a medium intensity mode. In each of the records of Nos. 5, 9, 11, 14, 15, 18, 19, and 21, the maintenance manner data indicates that a suction purge was performed by the purging unit 8 at a low intensity mode. In the illustrative embodiment, for example, the suction intensity modes "high", "medium", and "low" in a suction purge are realized by respective different operating durations of the suction pump 23. In other words, the suction intensity modes "high", "medium", and "low" are realized by a long operating duration, a medium operating duration, and a short operating duration of the suction pump 23 relative to each other.

In each of the records of Nos. 13 and 17, the maintenance manner data indicates that flushing using the foam 7 was performed. In flushing according to the records of Nos. 13 and 17, a relatively high voltage is applied by the controller 50 to a particular portion of the actuator 14 corresponding to a failure nozzle 10 detected by the failure nozzle detector 84 to perform flushing on the failure nozzle 10 at a high intensity mode. For example, the flushing intensity modes "high" and "low" are realized by a high voltage and a low voltage, respectively, to be applied by the controller 50.

In each record, the field "rank" indicates a rank representing an evaluation index for the maintenance manner adopted in previous maintenance. In each record, the maintenance manner data indicates the details of a maintenance manner adopted in particular maintenance for an ejection failure identified by the failure nozzle data, the occurrence area data, and the printer condition data in a corresponding record. A rank as an evaluation index is assigned to a maintenance manner adopted in each maintenance performed on a respective ejection failure according to the degree of improving ejection performance. The rank initially has a value of 5 that is an intermediate value of the scale. The greater the value, the higher the rank and the higher the evaluation. In a case where the ejection performance has been improved by a certain extent (e.g., not less than 50% of the failure nozzles 10 has been recovered) by maintenance in a particular maintenance manner having rank "5", the rank of the particular maintenance manner is raised (i.e., rank "6"). That is, the value indicating the rank is incremented by one, and thus, the rank becomes higher than rank "5". In a case where the ejection performance has not been changed or has not been improved by the certain extent (e.g., less than 50% of the failure nozzles 10 has been recovered) although maintenance was performed in the particular maintenance manner having rank "5", the rank of the particular maintenance manner is lowered (i.e., rank "4"). That is, the value indicating the rank is decremented by one, and thus, the rank becomes lower than rank "5". After that, in a case where maintenance is performed in the same particular maintenance manner for an ejection failure occurred in the same situation, if the ejection performance has been improved by the certain extent by the maintenance, the rank of the adopted maintenance manner is raised, that is, the value indicating the rank is incremented by one. If the ejection performance has not been changed or has not been improved by the certain extent by the maintenance, the rank is lowered, that is, the value indicating the rank is decremented by one.

In each record, the field "rank update date" indicates the last date on which the rank was updated based on the evaluation of a maintenance manner adopted in maintenance that has been performed on an ejection failure identified by the failure nozzle data, the occurrence area data, and the printer condition data. In a case where a maintenance manner included in a particular record has not been adopted more than once, the date on which the maintenance manner was first adopted is indicated in the field "rank update date".

For example, the record of No. 1 indicates a case where a maintenance manner that is a suction purge at a high intensity mode was adopted in particular maintenance in a situation where the failure nozzle percentage is 50% or more and the average temperature since the last ejection failure detection is Y1 [° C.] or higher. The record of No. 1 further indicates that the last date on which such a maintenance manner was adopted is Feb. 5, 2020 and the evaluation index that has been updated on the same day, that is, the current rank indicates rank "9".

The record of No. 2 indicates another case where another maintenance manner that is a suction purge at a high intensity mode and an exhaust purge were both adopted in another particular maintenance in a situation where the failure nozzle percentage is 50% or more and the average temperature since the last ejection failure detection is Y1 [° C.] or higher. The record of No. 2 further indicates that the last date on which such a maintenance manner was adopted is Feb. 10, 2020 that is later than that in the record of No. 1. Nevertheless, the record of No. 2 indicates that the evaluation index that has been updated on the same day, that is, the current rank indicates rank "8" that is lower than that in the record of No. 1.

Different maintenance manners may be adopted for ejection failures occurred in the same situation. In this case, the respective cases are recorded as different cases in the database DB. In a case where an ejection failure occurs in the same situation as the situation indicated in those records, in the illustrative embodiment, the maintenance manner having the highest rank thereamong is to be adopted. More specifically, for example, it is assumed that the rank of the maintenance manner in the record of No. 2 has rank "10" as of Feb. 9, 2020 and an ejection failure has occurred twice on Feb. 10, 2020 in a situation where the failure nozzle percentage is 50% or more and the average temperature since the last ejection failure detection is Y1 [° C.] or higher. That is, an ejection failure has occurred twice on Feb. 10, 2020 in the same situation as the situation indicated in each of the records of Nos. 1 and 2. When the first ejection failure occurred, the maintenance manner in the record of No. 2 has rank "10" that was higher than the rank "9" of the maintenance manner in the record of No. 1. Thus, the maintenance manner in the record of No. 2 was adopted in maintenance for the first ejection failure. That is, a suction purge at a high intensity mode and an exhaust purge were both performed as the maintenance. Nevertheless, the ejection performance has not been changed or has not been improved by the certain extent. Thus, the rank of the maintenance manner in the record of No. 2 was lowered by one rank from rank "10" to rank "9". When the second ejection failure occurred, the maintenance manner in the record of No. 2 has the same rank as the rank of the maintenance manner in the record of No. 1. In this case, the maintenance manner with the latest update date is determined as a maintenance manner to be adopted. Thus, the maintenance manner in the record of No. 2 was again adopted in maintenance for the second ejection failure. Nevertheless, the ejection performance has not been changed or has not been improved by the certain extent. Thus, the rank of the maintenance manner in the record of No. 2 was further lowered by one rank from rank "9" to rank "8". Accordingly, in a case where an ejection failure occurs in the same situation after the rank of the maintenance manner in the record of No. 2 was updated twice on Feb. 10, 2020, the maintenance manner in the record of No. 1 is to be adopted in maintenance for the ejection failure.

The records of Nos. 1 and 2 may indicate the evaluation results of the respective maintenance manners adopted in maintenance performed in the same printer 1 or in different printers 1.

For example, the record of No. 9 indicates another case where another maintenance manner that is a suction purge at a low intensity mode was adopted in another particular maintenance in a situation where the failure nozzle percentage is 12.5% or more but less than 50% and failure nozzles are located randomly. The record of No. 9 further indicates that the last date on which such a maintenance manner was adopted is Jan. 30, 2020 and the evaluation index that has been updated on the same day, that is, the current rank indicates rank "7".

The record of No. 10 indicates another case where another maintenance manner that is a suction purge at a medium intensity mode was adopted in another particular maintenance in a situation where the failure nozzle percentage is 12.5% or more but less than 50% and the failure nozzles are located randomly. The record of No. 10 further indicates that the last date on which such a maintenance manner was adopted is Feb. 11, 2020 that is later than that in the record of No. 9. Nevertheless, the record of No. 10 indicates that the evaluation index that has been updated on the same day, that is, the current rank indicates rank "9" that is higher than that in the record of No. 9.

More specifically, for example, it is assumed that the maintenance manner in the record of No. 10 has rank "8" as of Feb. 11, 2020 and an ejection failure has occurred on Feb. 11, 2020 in a situation where the failure nozzle percentage is 12.5% or more but less than 50% and the failure nozzles are located randomly. That is, an ejection failure has occurred in the same situation as the situation indicated in each of the records of Nos. 9 and 10. When the ejection failure occurred, the maintenance manner in the record of No. 10 has rank "8" that was higher than rank "7" of the maintenance manner in the record of No. 9. Thus, the maintenance manner in the record of No. 10 was adopted in maintenance for the ejection failure. That is, a suction purge at a medium intensity mode was performed as the maintenance. As a result of the maintenance, the ejection performance has been improved by the certain extent. Thus, the rank of the maintenance manner in the record of No. 10 was raised by one rank from rank "8" to rank "9". Accordingly, in a case where an ejection failure occurs in the same situation after the rank of the maintenance manner in the record of No. 10 was updated on Feb. 11, 2020, the maintenance manner in the record of No. 10 is to be adopted in maintenance for the ejection failure.

Control Procedure for Maintenance

Figure 4:
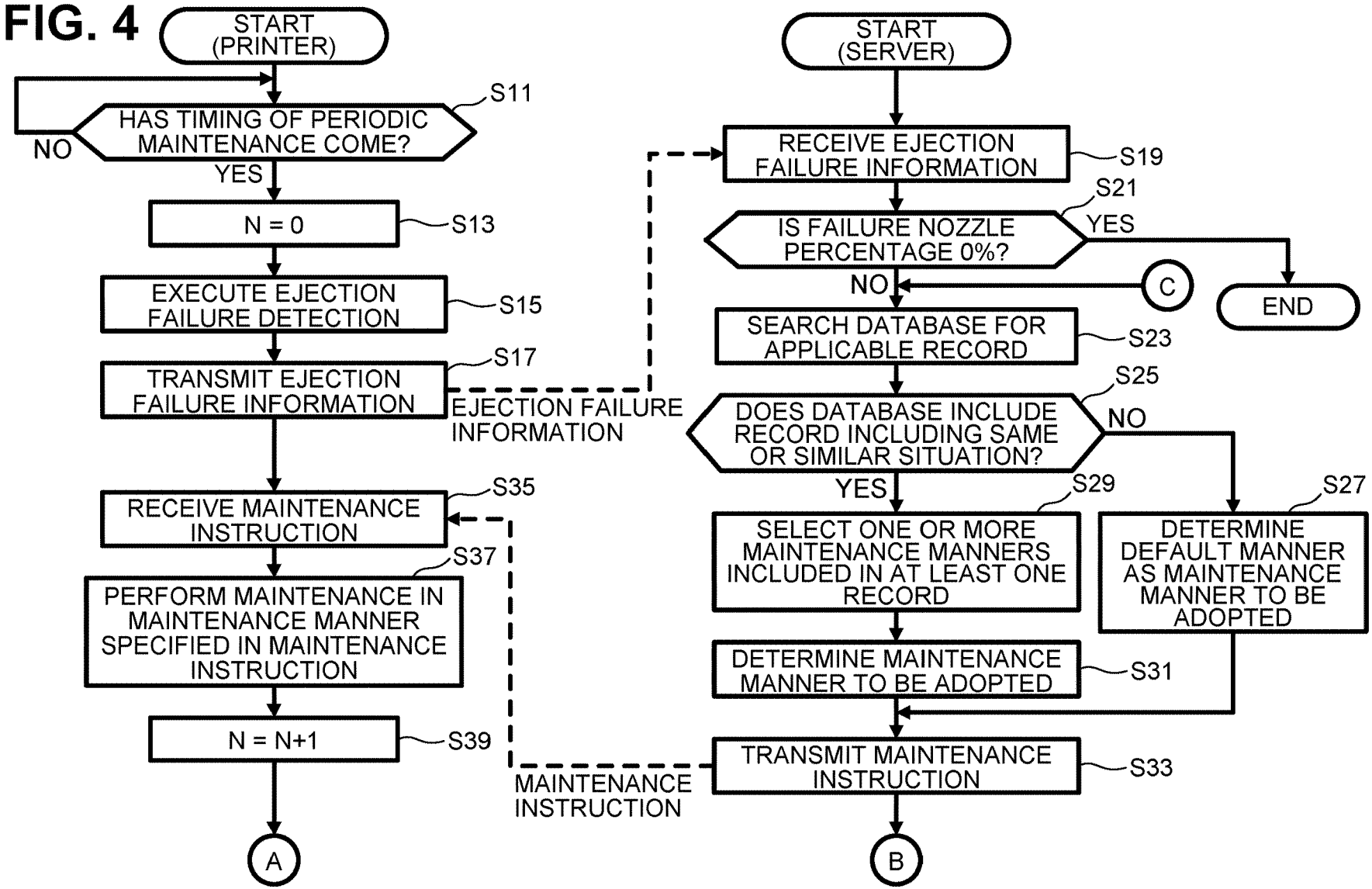
FIG. 4 is a flowchart of a control procedure executed by a CPU of the printer and a CPU of the server in cooperation with each other according to one or more illustrative embodiments of the disclosure.
Figure 5:
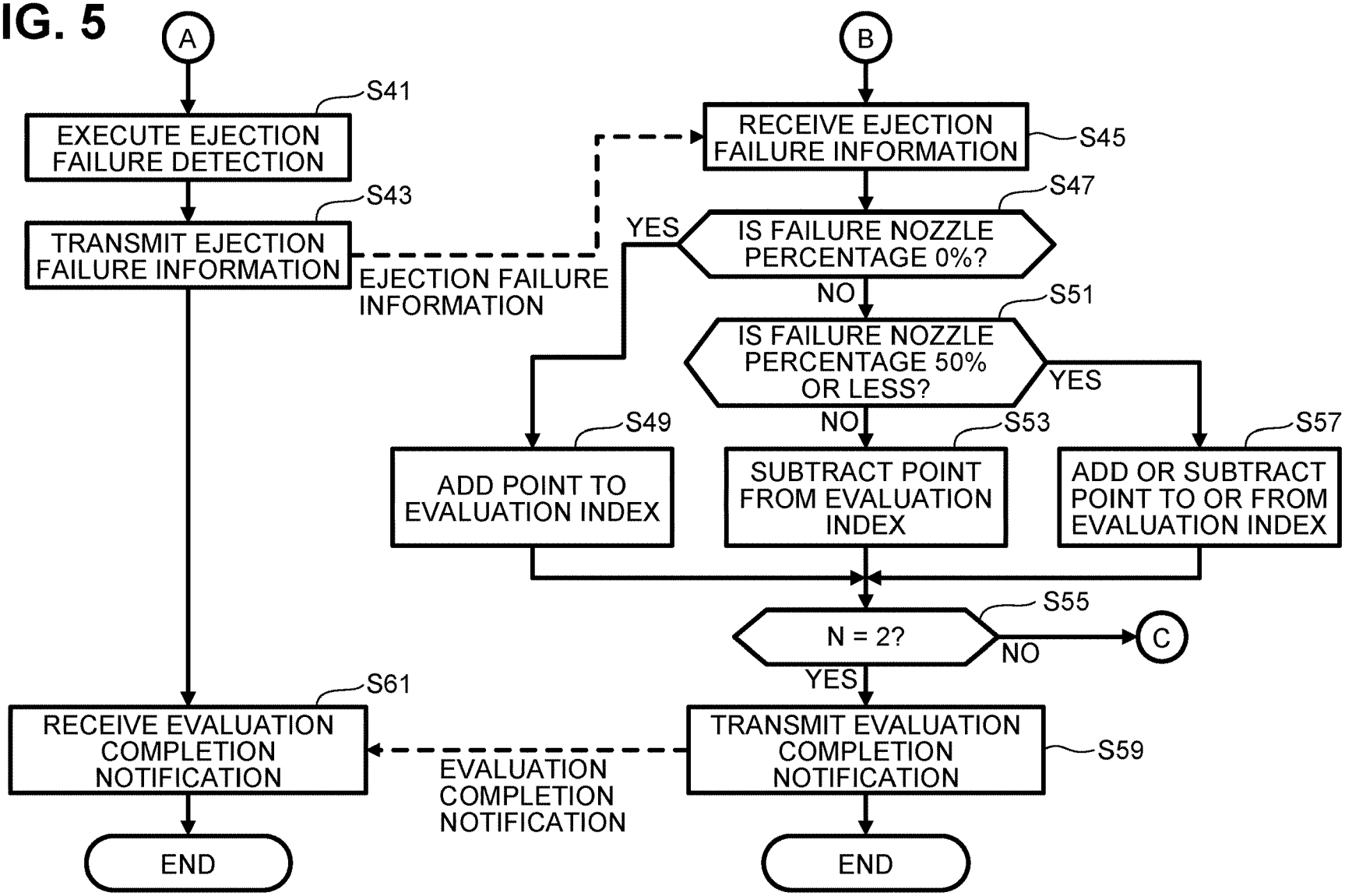
FIG. 5 is a continuation of the flowchart of FIG. 4 according to one or more illustrative embodiments of the disclosure.

Referring to FIGS. 4 and 5, a description will be provided on a control procedure executed by the CPU 51 of the printer 1 and the CPU 220 of the server 200 in cooperation with each other with reference to the database DB (refer to FIGS. 3A and 3B). The following maintenance processing is implemented by the control procedure in which the CPU 51 of the printer 1 and the CPU 220 of the server 200 execute a maintenance processing program included in programs stored in the ROM 52 and the memory 210.

As illustrated in FIG. 4, in the printer 1, the CPU 51 determines whether the timing of periodic maintenance has come (e.g., step S11). If the CPU 51 determines that the timing of periodic maintenance has come (e.g., YES in step S11), the CPU 51 initializes a variable N to 0 (zero) (e.g., step S13). The variable N indicates the number of times maintenance has been performed. Subsequent to step S13, the CPU 51 executes an ejection failure detection (e.g., step S15). More specifically, the CPU 51 causes the failure nozzle detector 84 to detect a failure nozzle 10 via the ejection detector 64, that is, determines whether an ejection failure has occurred. At step S15, the CPU 51 also causes each sensor (e.g., the temperature sensor) to detect a corresponding condition. Subsequent to step S15, the CPU 51 transmits, to the server 200, a result of the ejection failure detection executed by the failure nozzle detector 84 (e.g., step S17). The result of the ejection failure detection includes information corresponding to the failure nozzle data, information corresponding to the occurrence area data, and information corresponding to the printer condition data. Hereinafter, the information corresponding to the failure nozzle data, the information corresponding to the occurrence area data, and the information corresponding to the printer condition data are collectively referred to as "ejection failure information". The information corresponding to the failure nozzle data and the information corresponding to the occurrence area data both transmitted to the server 200 in step S17 may be examples of first condition information. The information corresponding to the printer condition data transmitted to the server 200 in step S17 may be an example of third condition information. In the illustrative embodiment, if the CPU 51 determines, in step S11, that the timing of periodic maintenance has come (e.g., YES in step S11), the CPU 51 executes step S13 and the subsequent steps. Nevertheless, in other embodiments, the CPU 51 may execute step S13 and the subsequent steps in response to receiving an instruction to start printing or in response to the power of the printer 1 being turned on.

In the server 200, in response to the printer 1 transmitting the ejection failure information to the server 200, the CPU 220 receives the ejection failure information from the printer 1 (e.g., step S19). Subsequent to step S19, the CPU 220 determines, based on the received ejection failure information, whether all the nozzles 10 are normal, that is, whether the failure nozzle percentage is 0% (e.g., step S21). If the CPU 220 determines that the failure nozzle percentage is 0% (e.g., YES in step S21), no maintenance is to be performed on the inkjet head 3. Thus, the routine ends. If the CPU 220 determines that the failure nozzle percentage is more than 0% (e.g., NO in step S21), the CPU 220 accesses the database DB stored in the memory 210. The CPU 220 searches the database DB for a record applicable to the ejection failure information (e.g., step S23). The applicable record includes a record indicating the same or similar situation to the situation where the currently ejection failure has occurred described in the ejection failure information. In this illustrative embodiment, "the record indicating similar situation" may be a record in which a condition indicated by at least one of the failure nozzle data, the occurrence area data, or the printer condition data includes a condition indicated by the ejection failure information.

Subsequent to step S23, the CPU 220 determines whether the database DB includes at least one record including the same or similar situation (e.g., step S25). If the CPU 220 determines that the database DB does not include any of such record (e.g., NO in step S25), the routine proceeds to step S27. In this illustrative embodiment, the CPU 220 determines that the database DB does not include at least one record including the same or similar situation in a case where the database DB does not include a record in which a condition indicated by at least one of the failure nozzle data, the occurrence area data, or the printer condition data includes a condition indicated by the ejection failure information. In step S27, the CPU 220 determines a default manner as a maintenance manner to be adopted. Details of the default manner is predetermined. The default manner includes, for example, a suction purge at a medium intensity mode. Subsequent to step S27, the routine proceeds to step S33. The default manner may be an example of a specific maintenance manner.

If the CPU 220 determines that the database DB includes at least one record including the same or similar situation (e.g., YES in step S25), the routine proceeds to step S29. In step S29, the CPU 220 selects each maintenance manner included in the at least one record including the same or similar situation.

In a case where the received ejection failure information indicates that an ejection failure has occurred in a situation where the failure nozzle percentage is 50% or more and the average temperature since the last ejection failure detection is Y1 [° C.] or higher, the CPU 220 selects the maintenance manners included in the respective records of Nos. 1 and 2. The maintenance manner in the record of No. 1 includes a suction purge at a high intensity mode. The maintenance manner in the record of No. 2 includes a suction purge at a high intensity mode and an exhaust purge. In a case where the received ejection failure information indicates that an ejection failure has occurred in a situation where the failure nozzle percentage is 12.5% or more but less than 50% and the failure nozzles are located randomly, the CPU 220 selects the maintenance manners included in the respective records of Nos. 9 and 10. The maintenance manner in the record of No. 9 includes a suction purge at a low intensity mode. The maintenance manner in the record of No. 10 includes a suction purge at a medium intensity mode.

Subsequent to step S29, the CPU 220 determines, as a maintenance manner to be adopted, the maintenance manner having the highest rank at this moment among the maintenance manners selected in step S29 (e.g., step S31).

More specifically, for example, in a case where the CPU 220 selects the maintenance manners in the respective records of Nos. 1 and 2 (e.g., step S29), the CPU 220 determines, as a maintenance manner to be adopted, the maintenance manner in the record of No. 1 that has a higher rank than the rank of the maintenance manner in the record of No. 2. That is, a suction purge at a high intensity mode is to be adopted. In a case where the CPU 220 selects the maintenance manners in the respective records of Nos. 9 and 10 (e.g., step S29), the CPU 220 determines, as a maintenance manner to be adopted, the maintenance manner in the record of No. 10 that has a higher rank than the rank of the maintenance manner in the record of No. 9. That is, a suction purge at a medium intensity mode is to be adopted.

In a case where the CPU 220 selects different maintenance manners having the same rank from two or more applicable records (e.g., step S29), the CPU 220 determines, as a maintenance manner to be adopted, the maintenance manner that was adopted in the latest maintenance, that is, the maintenance manner with the latest update date. More specifically, for example, in a case where the CPU 220 selects the maintenance manners in the respective records of Nos. 15 and 16, the CPU 220 determines, as a maintenance manner to be adopted, the maintenance manner in the record of No. 16. That is, a suction purge at a medium intensity mode is to be adopted for an ejection failure currently occurring in a situation where the failure nozzle percentage is less than 12.5% and the average temperature since the last ejection failure detection is Y2 [° C.] or higher.

Nevertheless, in other embodiments, in a case where the CPU 220 selects the maintenance manners having the same rank (e.g., step S29), the CPU 220 may determine, as a maintenance manner to be adopted, the maintenance manner in which less ink is consumed during maintenance as compared with the other maintenance manners. For example, ink consumption amount increases in the order of flushing, a suction purge at a low intensity mode, a suction purge at a medium intensity mode, and a suction purge at a high intensity mode.

As described above, in steps S27 and S31, a maintenance manner to be adopted is determined based on the search for an applicable record in the database DB in step S23 and based on the sameness or similarity of the ejection failure information with respect to the ejection failure data, the occurrence area data, and the printer condition data in each record.

That is, in regard to the field "failure nozzle percentage/pattern" and the field "occurrence area" in the database DB, a maintenance manner to be adopted may be determined based on at least one of the information corresponding to the failure nozzle data (e.g., the first data) or the information corresponding to the occurrence area data (e.g., the second data) included in the ejection failure information. More specifically, for example, as described above, a maintenance manner to be adopted may be determined based on the percentage of failure nozzles with respect to the total number of nozzles 10, whether the failure nozzles 10 are located next to each other in the main scanning direction, and where the failure nozzles are located with respect to an ink channel (e.g., an upstream portion or a downstream portion of the inkjet head 3).

In regard to the field "printer condition" in the database DB, a maintenance manner to be adopted may be determined based on the information corresponding to the printer condition data included in the ejection failure information.

In particular, in the illustrative embodiment, a maintenance manner to be adopted may be determined based on the information corresponding to the failure nozzle data, the information corresponding to the occurrence area data, and the information corresponding to the printer condition data.

Subsequent to step S31 or S27, the CPU 220 transmits, to the printer 1, an instruction to perform maintenance in the maintenance manner determined in step S31 or S27 (hereinafter, simply referred to as a maintenance instruction) (e.g., step S33). In response to this, in the printer 1, the CPU 51 receives the maintenance instruction from the server 200 (e.g., step S35). Subsequent to step S35, in the printer 1, the CPU 51 causes the printer 1 to perform maintenance in the maintenance manner specified in the received maintenance instruction (e.g., step S37). The maintenance instruction may be an example of maintenance information. Subsequent to step S37, the CPU 51 increments the variable N by 1 (one) (e.g., step S39).

Subsequent to step S39, as illustrated in FIG. 5, in the printer 1, as with step S15, the CPU 51 determines, via the ejection detector 64, whether an ejection failure has occurred with respect to each nozzle 10 (e.g., step S41). Subsequent to step S41, as with step S17, the CPU 51 transmits, to the server 200, ejection failure information as the result of the ejection failure detection (e.g., step S43). The ejection failure information transmitted to the server 200 in step S43 may be an example of second condition information.

In the server 200, in response to the printer 1 transmitting the ejection failure information to the server 200, as with step S19, the CPU 220 receives the ejection failure information from the printer 1 (e.g., step S45). Subsequent to step S45, as with step S21, the CPU 220 determines, based on the received ejection failure information, whether the failure nozzle percentage is 0% (e.g., step S47). If the CPU 220 determines that the failure nozzle percentage is 0% (e.g., YES in step S47), the CPU 220 determines that the maintenance manner adopted in the maintenance performed in step S37 was effective for the currently-occurring ejection failure, and thus increments the evaluation index of the adopted maintenance manner by one (e.g., step S49). That is, the rank of the maintenance manner is raised. Facts that the maintenance manner adopted in the maintenance performed in step S37 was effective for the currently-occurring ejection failure refers to the ejection performance having been improved by the certain extent. Thus, the updated rank of the maintenance manner adopted for the currently-occurring ejection failure is recorded in the database DB.

In other words, in a case where, in step S25, the CPU 220 determines that the database DB includes the record including same situation as the situation when the current ejection failure has occurred, the printer 1 performs maintenance in the same maintenance manner as the maintenance manner in the record in step S37. Thereafter, in the server 200, the CPU 220 increments the value indicating the current rank of the adopted maintenance manner by one and overwrites the current rank with a new rank.

In a case where, in step S25, the CPU 220 determines that the database DB includes the record including similar situation to the situation when the current ejection failure has occurred, the printer 1 performs maintenance in the same maintenance manner as the maintenance manner in the record in step S37. Thereafter, in the server 200, the CPU 220 generates a new record that is different from the record including the similar situation, and stores the generated record in the database DB. That is, the newly-generated record includes the details of the ejection failure information transmitted in step S17 and received in step S19, the maintenance manner adopted in the maintenance performed in step S37, and the updated rank. The details of the ejection failure information include the information corresponding to the failure nozzle data, the information corresponding to the occurrence area data, and the information corresponding to the printer condition data detected in step S15. In response to completion of step S49, the routine proceeds to step S55.

If the CPU 220 determines that the failure nozzle percentage is not 0% (e.g., NO in step S47), the CPU 220 determines whether the failure nozzle percentage is 50% or less (e.g., step S51). If the CPU 220 determines that the failure nozzle percentage is higher than 50% (e.g., NO in step S51), the CPU 220 determines that the maintenance manner adopted in the maintenance performed in step S37 is not effective for the currently-occurring ejection failure, and thus decrements the evaluation index by one (e.g., step S53). That is, the rank of the maintenance manner is lowered. Thus, the updated rank of the maintenance manner adopted for the currently-occurring ejection failure is recorded in the database DB.

In other words, in a case where, in step S25, the CPU 220 determines that the database DB includes the record including same situation as the situation when the current ejection failure has occurred, the printer 1 performs maintenance in the same maintenance manner as the maintenance manner in the record in step S37. Thereafter, in the server 200, the CPU 220 decrements the value indicating the current rank of the adopted maintenance manner by one and overwrites the current rank with a new rank.

In a case where, in step S25, the CPU 220 determines that the database DB includes the record including similar situation to the situation when the current ejection failure has occurred, the printer 1 performs maintenance in the same maintenance manner as the maintenance manner in the record in step S37. Thereafter, in the server 200, the CPU 220 generates a new record that is different from the record including the similar situation, and stores the generated record in the database DB. That is, the newly-generated record includes the details of the ejection failure information transmitted in step S17 and received in step S19, the maintenance manner adopted in the maintenance performed in step S37, and the updated rank. The details of the ejection failure information include the information corresponding to the failure nozzle data, the information corresponding to the occurrence area data, and the information corresponding to the printer condition data detected in step S15. In response to completion of step S53, the routine proceeds to step S55.

If the CPU 220 determines that the failure nozzle percentage is 50% or less (e.g., YES in step S51), the CPU 220 determines that the maintenance manner adopted in the maintenance performed in step S37 was effective for the currently-occurring ejection failure but the ejection performance has not been completely recovered, and thus increments or decrements by one the evaluation index according to the degree of improvement (e.g., step S57). That is, the rank of the maintenance manner is raised or lowered. Thus, the updated rank of the maintenance manner adopted for the currently-occurring ejection failure is recorded in the database DB. The updated rank is recorded in the database DB in the same manner as the other cases described above. If, in step S51, the CPU 220 determines that the failure nozzle percentage is 50% or less (e.g., YES in step S51), the failure nozzle percentage is more than 0%. This refers that ejection performance has not been completely recovered, that is, the nozzles 10 still include at least one failure nozzle. Thus, in other embodiments, in step S57, the CPU 220 may decrement by one the evaluation index in all cases. Nevertheless, in other embodiments, in step S57, the CPU 220 may not change the evaluation index. In response to completion of step S57, the routine proceeds to step S55.

Subsequent to step S49, S53, or S57, the routine proceeds to step S55. In step S55, the CPU 220 determines whether the variable N is equal to 2. In a case where the variable N is equal to 1 (one) (i.e., N=1), the CPU 220 determines that the variable N is not equal to 2 (e.g., NO in step S55). Thus, the routine returns to step S23. In step S23, the CPU 220 searches the database DB for an applicable record and executes the subsequent steps. If the CPU 220 determines that the variable N is equal to 2 (e.g., YES in step S55), the CPU 220 transmits an evaluation completion notification to the printer 1 (e.g., step S59). That is, in this illustrative embodiment, the CPU 220 executes steps S23 to S57 in FIGS. 4 and 5 two times. Nevertheless, in other embodiments, the CPU 220 may execute steps S23 to S57 in FIGS.

4 and 5 only one time, or three or more times. In response to the server 200 transmitting the notification to the printer 1, the CPU 51 receives the notification from the server 200 (e.g., step S61). Then, the control procedure ends. In other embodiments, the transmission (e.g., step S59) and reception (e.g., step S61) of the evaluation completion notification may be skipped.

Effects Achieved by Illustrative Embodiment

As described above, in the illustrative embodiment, each maintenance manner is rated on a scale of points that indicates a rank of a respective maintenance manner. The rank corresponds to an evaluation index indicating effectiveness of a maintenance manner for recovering ejection performance. Each time maintenance is performed, the rank of the maintenance manner adopted in the maintenance is reviewed.

In other words, in a case where the failure nozzle detector 84 determines that an ejection failure has occurred in the printer 1, the CPU 51 transmits, to the server 200, the detection result of the failure nozzle detector 84 (e.g., step S17). The detection result includes information corresponding to the failure nozzle data and information corresponding to the occurrence area data, both of which are related to a situation when the detected ejection failure has occurred. Subsequent to step S17, the CPU 51 causes the printer 1 to perform maintenance in a suitable maintenance manner determined based on the information corresponding to the failure nozzle data and the information corresponding to the occurrence area data (e.g., step S37). Thereafter, the CPU 51 transmits, to the server 200, the detection result of the failure nozzle detector 84 again (e.g., step S43). The detection result includes information corresponding to the failure nozzle data and the occurrence area data, both of which are related to the situation when the detected ejection failure has occurred. Based on both information transmitted to the server 200 from the printer 1 in steps S17 and S43, in the server 200, the CPU 220 updates the rank of the adopted maintenance manner, that is, rates again the adopted maintenance manner (e.g., step S49, S53, or S57). More specifically, in a case where the information received by the server 200 in step S45 indicates that the ejection performance has been improved by the certain extent as compared with the information received by the server 200 in step S19, the CPU 220 determines that the maintenance manner adopted in the performed maintenance was effective for the currently-occurring ejection failure, and thus the rank of the maintenance manner is raised (e.g., step S49 or S57). In a case where the information received by the server 200 in step S45 indicates that the ejection performance has not been changed or has not been improved by the certain extent as compared with the information received by the server 200 in step S19, the CPU 220 determines that the maintenance manner adopted in the performed maintenance is not effective for the currently-occurring ejection failure, and thus the rank of the maintenance manner is lowered (e.g., step S53 or S57).

According to the illustrative embodiment, each time maintenance is performed in the determined maintenance manner, the rank of the maintenance manner adopted in the maintenance is reviewed. Thus, the maintenance manner that is not effective for a particular ejection failure has a lower rank and the maintenance manner that is effective for the particular ejection failure has a higher rank. Consequently, the printing system may recommend a suitable maintenance manner to the owner of the printer 1.

Nevertheless, in other embodiments, in a case where the information received by the server 200 in step S45 indicates that the ejection failure has been resolved, the rank may be raised (e.g., step S49). In a case where the ejection failure information indicates that the ejection failure has not been resolved, the rank may be lowered. Such a rating may explicitly indicate that the ejection failure has been resolved by maintenance in the adopted maintenance manner and thus the ejection performance has been completely recovered. Consequently, the printing system may recommend a suitable maintenance manner to the owner of the printer 1 reliably.

In the illustrative embodiment, in step S17, in response to the printer 1 transmitting, to the server 200, information regarding a situation when an ejection failure has occurred based on a result of an ejection failure detection, the CPU 220 of the server 200 determines a maintenance manner to be adopted that may be suitable for the received information (e.g., step S31). Subsequent to step S31, the CPU 220 transmits, to the printer 1, a maintenance instruction to perform maintenance in the maintenance manner determined in step S31 (e.g., step S33). In response to receiving the maintenance instruction, the CPU 51 causes the printer 1 to perform maintenance in the maintenance manner specified in the maintenance instruction (e.g., step S37). Thus, the CPU 220 of the server 200 may determine a maintenance manner suitable for the detected ejection failure at that moment and enable the printer 1 to perform maintenance in the determined maintenance manner. After the printer 1 performs the maintenance in the determined maintenance manner, the CPU 220 of the server 200 reviews the evaluation index, that is, the rank of the maintenance manner adopted in the maintenance (e.g., step S49, S53, or S57).

Consequently, the printing system may recommend a suitable maintenance manner to the owner of the printer 1 more reliably.

In the illustrative embodiment, in the server 200, in step S31, the CPU 220 determines a maintenance manner to be adopted based on at least one of the information corresponding to the failure nozzle data (e.g., the first data) or the information corresponding to the occurrence area data (e.g., the second data). Thus, the CPU 220 may determine a maintenance manner to be adopted in detail based on at least one of the information indicating what percentage of failure nozzles are included or the information indicating an occurrence area of the failure nozzles.

In the illustrative embodiment, in step S31, the CPU 220 of the server 200 determines a maintenance manner to be adopted based on the percentage of failure nozzles with respect to the total number of nozzles 10. Thus, depending on the percentage of failure nozzles 10 with respect to the total number of nozzles 10, the CPU 220 of the server 200 may determine a suitable maintenance manner in detail. More specifically, the higher percentage of failure nozzles 10, the CPU 220 may determine a maintenance manner in which a stronger suction power is achieved or a maintenance manner in which a relatively longer duration of a suction time is achieved.

In the illustrative embodiment, in the server 200, in step S31, the CPU 220 determines a maintenance manner to be adopted based on the occurrence area of the failure nozzles 10. Examples of the occurrence areas of the failure nozzles 10 include an upstream portion of the inkjet head 3 along an ink channel and a downstream portion of the inkjet head 3 along an ink channel. Thus, the CPU 220 of the server 200 may determine a suitable maintenance manner to be adopted in detail. More specifically, in a case where the failure nozzles 10 are located at the downstream portion of the inkjet head 3, the CPU 220 may determines, as a maintenance manner to be adopted, a maintenance manner in which a higher intensity mode or a longer time duration is achieved as compared with a case where the failure nozzles 10 are located at the upstream portion of the inkjet head 3.

In the illustrative embodiment, in the server 200, in step S31, the CPU 220 determines a maintenance manner to be adopted based on whether the failure nozzles 10 are located next to each other in the main scanning direction. Thus, in such a case, the CPU 220 may determine a suitable maintenance manner in detail on an assumption that, the inkjet head 3 is adversely affected by a recording sheet P during sheet conveyance.

In the illustrative embodiment, in the server 200, in step S31, the CPU 220 determines a maintenance manner to be adopted based on the information corresponding to the printer condition data. Examples of the information corresponding to the printer condition data include temperature, humidity, and the presence or absence of a sheet conveyance failure. The temperature and the humidity may be the average temperature and the average humidity, respectively. The temperature and the humidity may alternatively be detected timely. The average temperature and the average humidity may be obtained based on a plurality of values detected in a certain cycle. According to the illustrative embodiment, a maintenance manner to be adopted may be determined in detail based on the various information.

Examples of the information corresponding to the printer condition data may further include environment information such as the presence or absence of paper particles and dust detected by an appropriate detector. Examples of the information corresponding to the printer condition data may further include various values counted by respective appropriate counters such as a total use time of a respective ink cartridge 32, the number of times of a respective ink cartridge 32 replaced, a total time during which the cap 21 is in the uncapping state where the nozzles 10 are not covered by the cap 21, and the number of printed pages. In a case where a maintenance manner to be adopted is determined based on such information, the database DB may include various data corresponding to the various information.

In the illustrative embodiment, an update history of each maintenance manner that has been adopted is stored in the database DB of the server 200 in association with the information corresponding to the failure nozzle data and the information corresponding to the occurrence area data both related to the ejection failure occurring at that time.

In response to the server 200 receiving new information corresponding to the failure nozzle data and new information corresponding to the occurrence area data from the printer 1, the CPU 220 selects at least one maintenance manner applicable to the received information by referring to the database DB (e.g., step S29). Subsequent to step S29, the CPU 220 determines, as a maintenance manner to be adopted, a single maintenance manner among the at least one maintenance manner selected in step S29 (e.g., step S31). Thus, the CPU 220 may effectively and appropriately determine a maintenance manner to be adopted based on the at least one maintenance manner that has been actually adopted in maintenance performed before.

In the illustrative embodiment, the CPU 220 determines, as a maintenance manner to be adopted, the maintenance manner rated in the highest rank among the at least one maintenance manner selected in step S29 (e.g., step S31). Thus, the CPU 220 may determine a maintenance manner suitable for the information corresponding to the failure nozzle data and the information corresponding to the occurrence area data among the at least one maintenance manner that has been actually adopted in maintenance performed before.

In the illustrative embodiment, in a case where the CPU 220 selects two or more maintenance manners rated in the same rank in step S29, the CPU 220 determines, as a maintenance manner to be adopted, the maintenance manner with the latest update date or the maintenance manner in which less ink is consumed during maintenance as compared with the other maintenance manners. Thus, the CPU 220 may reliably determine a maintenance manner suitable for the information corresponding to the failure nozzle data and the information corresponding to the occurrence area data among the at least one maintenance manner that has been actually adopted in maintenance performed before.

In the illustrative embodiment, in a case where the database DB does not include a maintenance manner applicable to the information corresponding to the failure nozzle data and the information corresponding to the occurrence area data both received from the printer 1, the CPU 220 determines the default manner as a maintenance manner to be adopted (e.g., step S27). Thus, even when the CPU 220 determines that the database DB does not include an applicable maintenance manner although the CPU 220 searches the database DB including the maintenance manners, each of which has been actually adopted in maintenance performed before, such a determination control may enable the printer 1 to perform maintenance in at least some maintenance manner.

In the illustrative embodiment, the maintenance manner data includes at least one of a maintenance type or a suction intensity mode. In other embodiments, for example, the maintenance manner data may include an operating duration. Thus, maintenance cases may be classified by maintenance type (e.g., suction or flushing). Further, even when maintenance cases include the same maintenance types, the maintenance cases may be classified by intensity mode (e.g., high, medium or low) or operating duration. The different maintenance cases may be rated individually using a respective evaluation index.

Modifications

In the illustrative embodiment, a numerical value is used to indicate the rank as the evaluation index. In a case where the ejection performance has been improved by the certain extent, the value indicating the rank is incremented. In a case where the ejection performance has not been changed or has not been improved by the certain extent, the value indicating the rank is decremented. Nevertheless, such a numerical value might not necessarily be used as the evaluation index. In other embodiments, as the evaluation index, a non-numerical value may be used, such as "A", "B", or "C", or "excellent", "good", or "poor". In any case using such a non-numerical value, the rank only need to be raised to a higher evaluation in a case where the ejection performance has been improved by the certain extent, and the rank only need to be lowered by a lower evaluation in a case where the ejection performance has not been changed or has not been improved by the certain extent.

In the illustrative embodiment, the description has been provided on the example in which the printer 1 is owned by a service provider that offers a printing service and a customer (i.e., a user) obtains the printing service using the printer 1. Nevertheless, in other embodiments, the disclosure may be applied to another case where a user owns and uses the printer 1. In this case, the same effects as described above may be achieved.

In this illustrative embodiment, in S17 the printer 1 transmits, to the server 200, a result of the ejection failure detection. In response to receiving the result, the server 200 executes the steps S19 to S31. In S33 the server 200 transmits, to the printer 1, the instruction to perform maintenance in the maintenance manner determined in step S31 or S27. In S43 the printer 1 transmits, to the server 200, the ejection failure information as the result of the ejection failure detection. In response to receiving the ejection failure information, the server 200 executes the steps S47 to S55. In S59 the server 200 transmits the evaluation completion notification to the printer 1. Nevertheless, in modification, instead of the server 200, the printer 1 may execute the steps S19 to S31 and S47 to S55. That is, in this modification, the printer 1 may execute the steps described in FIGS. 4 and 5 without communicating with the server 200.

In the illustrative embodiments, the controller 50 of the printer 1 includes a single CPU 51. Nevertheless, in other embodiments, for example, the controller 50 may include a plurality of CPUs 51. In still other embodiments, for example, the controller 50 may include a combination of a CPU 51 and a hardware circuit such as the ASIC 55 or hardware circuits only.

In the above description, the sequence in the flowcharts of FIGS. 4 and 5 is merely an example, and therefore, may include another step or skip one or more steps or the sequence of steps may be changed without departing from the spirit and technical idea of the disclosure.

Further, one or more aspects of the illustrative embodiment and the modifications may be combined appropriately.

Various modifications may be made to the disclosure without departing from the spirit and scope of the disclosure.

What is claimed is:

1. A printing system comprising:

a controller configured to:

receive second condition information related to an ejection failure in a printer that has performed a maintenance;

determine whether an ejection performance in the printer has been improved based on the second condition information in response to performing the maintenance; and update an evaluation index in accordance with the determination of whether the ejection performance in the printer has been improved, the evaluation index corresponding to the performed maintenance, wherein updating the evaluation index includes: updating a rank of the performed maintenance based on (1) whether the ejection performance in the printer has been improved, and (2) if the ejection performance in the printer has been improved, an amount of improvement in the ejection performance.

2. The printing system according to claim 1, wherein the controller is configured to update the evaluation index such that:

the evaluation index indicates a higher effectiveness for the ejection failure if the ejection performance has been improved in response to performing the maintenance; and the evaluation index indicates a lower effectiveness for the ejection failure if the ejection performance has not been improved in response to performing the maintenance.

3. The printing system according to claim 2, wherein the controller is configured to update the evaluation index such that:

the evaluation index indicates the higher effectiveness for the ejection failure if the ejection failure is entirely resolved; and the evaluation index indicates the lower effectiveness for the ejection failure if the ejection failure is not entirely resolved.

4. The printing system according to claim 1, wherein the controller is configured to:

receive first condition information related to an ejection failure in a printer;

determine, from a plurality of maintenance manners, a maintenance manner applicable to the first condition information, wherein the plurality of maintenance manners are ranked relative to one another; and cause the printer to perform a maintenance in the determined maintenance manner.

5. The printing system according to claim 4, wherein the printer includes an ejection head, the ejection head having a plurality of nozzles, wherein the first condition information includes at least one of first data or second data, the first data indicating a percentage of nozzles causing the ejection failure among the plurality of nozzles, and the second data indicating a location pattern of the nozzles causing the ejection failure.

6. The printing system according to claim 5, wherein the location pattern of the second data indicates an occurrence area where the nozzles causing the ejection failure are detected, the occurrence area includes at least one of an upstream portion of the ejection head or a downstream portion of the ejection head.

7. The printing system according to claim 4, wherein the printer includes an ejection head, the ejection head having a plurality of nozzles, the ejection head being configured to eject ink from each of the plurality of nozzles while moving in a main scanning direction, and wherein the first condition information includes data indicating whether nozzles causing the ejection failure are located next to each other in the main scanning direction.

8. The printing system according to claim 4, wherein the printer includes a sensor, the sensor being configured to detect a condition of the printer, wherein the controller is further configured to:

receive third condition information indicating the detected condition by the sensor, wherein the controller is configured to determine the maintenance manner applicable to the first condition information and the third condition information.

9. The printing system according to claim 8, wherein the sensor is at least one of a temperature sensor, a humidity sensor, or a sensor that determines a sheet conveyance failure.

10. The printing system according to claim 4, wherein the printing system includes a memory storing a database, the database including a plurality of items, each item including a condition of the ejection failure and one of the plurality of maintenance manners associated with each other, wherein the controller is configured to determine, using the database, the maintenance manner applicable to the condition of the ejection failure indicated by the first condition information.

11. The printing system according to claim 10,
wherein each item in the database further includes the evaluation index, and
wherein in a case where the database includes a plurality of items corresponding to the maintenance manner applicable to the condition of the ejection failure indicated by the first condition information, the controller is configured to determine the maintenance manner that is associated with the evaluation index having a highest rank relative to the other maintenance manners.

12. The printing system according to claim 11,
wherein in a case where the database includes a plurality of items corresponding to the maintenance manner applicable to the condition of the ejection failure indicated by the first condition information, and each item includes the same evaluation index, the controller is configured to determine the maintenance manner indicated by the latest update date or the maintenance manner in which less ink is consumed during maintenance as compared with the other maintenance manners.

13. The printing system according to claim 11,
wherein, in a case where the maintenance manner applicable to the condition of the ejection failure indicated by the first condition information does not exist, the controller is configured to determine the maintenance manner that is predetermined.

14. The printing system according to claim 4,
wherein the plurality of maintenance manners are classified by at least one of a maintenance type, a maintenance power, or a maintenance duration.

15. A printing system comprising:
a printer including a first controller; and
a server including a second controller,
wherein the first controller is configured to:
cause the printer to perform a maintenance; and
transmit, to the server, second condition information related to an ejection failure in the printer after the maintenance is performed,
wherein the second controller is further configured to:
receive, from the printer, the second condition information;
determine whether an ejection performance in the printer has been improved based on the second condition information in response to performing the maintenance; and
update an evaluation index in accordance with determination of whether the ejection performance in the printer has been improved, the evaluation index corresponding to the performed maintenance, wherein updating the evaluation index includes: updating a rank of the performed maintenance based on (1) whether the ejection performance in the printer has been improved, and (2) if the ejection performance in the printer has been improved, an amount of improvement in the ejection performance.

16. The printing system according to claim 15,
wherein the first controller is configured to:
transmit, to the server, first condition information related to an ejection failure in the printer,
wherein the second controller is configured to:
receive, from the printer, the first condition information;
determine, from a plurality of maintenance manners, a maintenance manner applicable to the first condition information based on a rank of the maintenance manner among the plurality of maintenance manners, wherein the plurality of maintenance manners are ranked relative to one another; and
transmit, to the printer, information indicating the determined maintenance manner,
wherein the first controller is further configured to:
receive, from the server, the information indicating the determined maintenance manner; and
cause the printer to perform a maintenance in the determined maintenance manner.

17. A printing system comprising:
an ejection head having a plurality of nozzles, the ejection head being configured to eject ink from each of the plurality of nozzles while moving in a main scanning direction;
a memory storing a database, the database including a plurality of records including a first record and a second record, the first record including a first ejection failure condition, a first maintenance manner and a first index value associated with each other, the second record including the first ejection failure condition, a second maintenance manner and a second index value associated with each other; and
a controller configured to:
receive second condition information related to an ejection failure in a printer that has performed a maintenance;
determine an ejection performance in the printer based on the second condition information in response to performing the maintenance; and
update the first record in accordance with determination of the ejection performance, wherein updating the first record includes: updating the first index value of the first maintenance manner based on (1) whether the ejection performance in the printer has been improved by the first maintenance manner, and (2) if the ejection performance in the printer has been improved, an amount of improvement in the ejection performance.

18. The printing system according to claim 17,
wherein the second condition information includes a percentage of failure nozzles in the plurality of nozzles,
wherein the first index value is incremented if the percentage of the failure nozzles is less than a particular value, and
wherein the first index value is decremented if the percentage of the failure nozzles is not less than the particular value.

19. The printing system according to claim 18,
wherein the controller is configured to:
receive first condition information related to an ejection failure in the printer;
determine whether a condition indicated by the first condition information is the same or similar to the first ejection failure condition included in the database; and
if it is determined that the condition indicated by the first condition information is the same or similar to the first ejection failure condition, cause the printer to perform a maintenance of the ejection head in the first maintenance manner.

* * * * *